US005829598A

United States Patent [19]

Whitlock

[11] Patent Number: 5,829,598

[45] Date of Patent: Nov. 3, 1998

[54] METHOD AND APPARATUS FOR ELECTROSTATIC SEPARATION

[75] Inventor: David R. Whitlock, Belmont, Mass.

[73] Assignee: Separation Technologies, Inc., Needham, Mass.

[21] Appl. No.: 430,382

[22] Filed: Apr. 28, 1995

[51] Int. Cl.[6] ..... B03C 7/08

[52] U.S. Cl. ..... 209/128

[58] Field of Search ..... 209/127.1, 128, 209/129, 130, 131

[56] References Cited

U.S. PATENT DOCUMENTS

| | | | |
|---|---|---|---|
| 1,110,896 | 9/1914 | Comstock | 209/129 |
| 1,222,305 | 4/1917 | Kraus | 209/127.4 |
| 1,355,477 | 10/1920 | Howell | 209/127.3 |
| 2,689,648 | 9/1954 | Maestas | 209/131 |
| 2,847,124 | 8/1958 | Brastad | 209/127.1 |
| 2,889,042 | 6/1959 | Le Baron | 209/127.1 |
| 3,022,889 | 2/1962 | LeBaron | 209/127.2 |
| 3,140,714 | 7/1964 | Murphy, Jr. et al. | 209/2 UX |
| 3,247,960 | 4/1966 | Brastad | 209/11 |
| 3,449,938 | 6/1969 | Giddings . | |
| 3,493,109 | 2/1970 | Carta et al. | 209/127.1 |
| 3,635,340 | 1/1972 | Dunn | 209/130 |
| 3,664,939 | 5/1972 | Luner et al. | 204/299 |
| 4,122,022 | 10/1978 | Hauskins, Jr. | 209/127.1 |
| 4,137,156 | 1/1979 | Morey et al. | 209/212 |
| 4,172,028 | 10/1979 | Dunn | 209/127.1 |
| 4,302,245 | 11/1981 | Winters | 209/214 |
| 4,358,358 | 11/1982 | Rhodes | 204/180.1 |
| 4,440,638 | 4/1984 | Judy et al. | 204/302 |
| 4,476,004 | 10/1984 | Pohl | 204/302 |
| 4,517,078 | 5/1985 | Inculet et al. | 209/128 X |
| 4,839,032 | 6/1989 | Whitelock | 209/127.1 |
| 4,874,507 | 10/1989 | Whitlock | 209/127.1 |

FOREIGN PATENT DOCUMENTS

| | | | |
|---|---|---|---|
| A-0109828 | 5/1984 | European Pat. Off. . | |
| A-940389 | 12/1948 | France . | |
| 0705007 | 4/1941 | Germany | 209/127.3 |
| 0495088 | 3/1976 | U.S.S.R. | 209/131 |
| 0498042 | 3/1976 | U.S.S.R. | 209/131 |
| 1196033 | 12/1985 | U.S.S.R. | 209/127.1 |
| WO-A-8707532 | 12/1987 | WIPO . | |
| WO-A-8909092 | 10/1989 | WIPO . | |

OTHER PUBLICATIONS

SME Mineral Processing Handbook—Normal L. Weiss, Pub. By Society of Mining Engineers of the American Institute of Mining, Metallurgical, and Petroleum Engineers, Inc., 1985 pp. 6–34.

R.J. Adamson, and K.V.I.S. Kaler "An Automated Stream Centered Dielectrophoretic System", Conference Record of Record of the 1986 IEEE Industry Applications Society Annual Meeting Part II, Sep. 28–Oct. 3, 1986 1986, IEEE Catalog No. 86CH2272–3 pp. 1350–1354.

*Primary Examiner*—F. J. Bartuska
*Attorney, Agent, or Firm*—Wolf, Greenfield & Sacks, P.C.

[57] ABSTRACT

A belt-type counter-current separator for separating a mixture of particles, including conductive particles, includes a voltage radiant assembly having a plurality of conductive elements inter-disposed with a plurality of dielectric elements. The plurality of conductive elements are coupled to respective nodes of a voltage dividing circuit for dividing a voltage between a high potential electrode, of the electrostatic separator, and a reference potential. The plurality of conductive elements and dielectric elements in combination with the voltage dividing circuit limit a voltage potential between any adjacent conductive elements to a maximum potential so as to prevent sparking due the presence of conductive particles in the separator. In one embodiment of the separator, the voltage gradient assembly is an extruded plastic material having both conductive and non-conductive elements and pieces of alumina are disposed between the conductive elements to provide a durable voltage gradient surface.

32 Claims, 5 Drawing Sheets

METHOD AND APPARATUS FOR ELECTROSTATIC SEPARATION

BACKGROUND OF THE INVENTION

1. Field of the Invention

The present invention relates to improvements to counter-current belt-type electrostatic separation processes and equipment. In particular the present invention relates to a voltage gradient assembly to be used in electrostatic separators.

2. Discussion of the Related Art

Fly ash derived from coal combustion often contains unburned carbon residue, from particles of coal which have not burned during the passage through the boiler combustion zone. Recently, the unburned carbon residue has been greatly exacerbated by changes to boiler operation which have been implemented to reduce NOx emissions. One potential use for such fly ash is as a pozzolanic additive in concrete. Fly ash in concrete reacts with the free lime to form cementacious products which produce additional strength in the cured concrete. Other improved concrete properties include lower water content, lower heat of hydration, lower cost, easier flowability, and lower permeability. However, the unburned carbon residue, in the fly ash derived from coal combustion, is undesirable for reuse of the fly ash in such concrete applications. The unburned carbon in fly ash greatly limits the beneficial use of fly ash in concrete.

While coal is a fairly good insulator, carbon derived from coal pyrolysis is a good conductor, with a resistivity well below 1 ohm/cm. The carbon particles in fly ash are derived from particles of coal which have been pyrolyzed and partially combusted. During this pyrolysis and partial combustion, volatiles are evolved from the coal so that the residual carbon particles have a very low bulk density and are quite porous. Typical carbon contents of fly ash are in the 7 to 12% range, and many are above 15%. The ASTM C-618 specification for fly ash as a pozzolan for concrete use calls for less than 6% Loss on Ignition (LOI). This specification is a measure of the carbon content because the carbon burns off during the ignition at 750 centigrade. Many engineering projects have specifications for fly ash that are even more stringent than the ASTM specification, for example the large civil engineering project that is underway in Boston, the Boston Harbor Central Artery Project calls for less than 3% LOI.

In addition, the unburned carbon has fuel value, and can be productively burned in the boiler that generated the ash in the first place. The efficient use of this carbon as a fuel requires that it be concentrated as much as possible to avoid overloading the electrostatic precipitator and erosion of the convection tubes.

Carbon in fly ash is an example of a conductive particulate material in a non-conductive material. The conductivity of such a composite depends upon the connectivity of the conductive phase. Referring to FIG. 1, from percolation theory, the resistivity (inverse of conductivity) of a composite system decreases with the coordination of conductive particles with each other, and when that coordination exceeds a certain value, the resistivity of the composite decreases dramatically with a small volume increase of the conductive material. This occurs at about 37% by volume of conductive material. Below this level, there are insufficient connections between particles to form a contiguous bridge from one surface to the other. Above this level there are sufficient adjacent particles to form a contiguous bridge from one surface to the other. This percolation threshold for resistivity (conductivity) is well documented and described by J. Girland in Transactions of the Metallurgical society of AIME volume 236, page 642–646 May 1966. The percolation threshold of 37 volume % of the more conductive material is representative of many systems, in that it derives from purely geometric considerations.

In coal-derived fly ash, the carbon has a much lower specific gravity than the mineral ash material. This reduced bulk density translates in a higher specific volume and hence, for a 37 volume % carbon in fly ash occurs at approximately 10 weight % carbon in fly ash. This percolation threshold of 10% by weight of carbon presents substantial difficulties in the separation of carbon from fly ash. Although previous descriptions of belt-type electrostatic separators have mentioned the potential of separating conductive particles, they have not specifically addressed specific conductive materials. U.S. Pat. Nos. 4,839,032 and 4,874,507, disclose a separator which is applicable to the triboelectric/electrostatic separation of a diverse mixtures of particles, including conductive particles. In principle, this type of separator can separate essentially all materials which have triboelectric contact charging properties, including conductors. This type of electrostatic counter-current belt-type separator has demonstrated, in the laboratory, an ability to separate diverse mixtures of particles.

SUMMARY OF THE INVENTION

While in principle, conductive particles can be separated, and separation of conductive particles has been demonstrated, in the laboratory, the long-term commercial use of a counter-current belt-type separator, such as disclosed in U.S. Pat. Nos. 4,839,032 and 4,874,507, on mixtures containing conductive particles is problematic due to a build up of conductive deposits between regions of different electrical potential within the separator.

FIG. 2 illustrates one embodiment of the counter-current belt-type separator 100, and as described in U.S. Pat. Nos. 4,839,032 and 4,874,507, which utilizes a strong electric field to move triboelectrically charged particles from one moving stream to an adjacent stream moving in an opposite direction. The electric field is formed by two parallel electrodes 9 and 10 through which the belt segments 8A and 8B of belt 8 and the streams of particles move. To contain the particles and to support the electrodes, it is necessary to provide a mechanical connection between the two electrodes, along their longitudinal edges and perpendicular to the electrodes 9, 10, and belt segments 8A, 8B. It is in this region that particles of conductive carbon can collect and cause bridging of a conductive nature between electrodes 9, 10, and thus short-circuit the electrodes. This short-circuiting of the electrodes 9, 10 causes a reduction in the electric field and an overall degradation in the separator 100 and the separation process.

In principal, one could simply use a more powerful source of high voltage, with higher current capability to offset the electric field degradation due to this local short-circuiting effect. However, for some applications this is not feasible. For example, a layer of carbon with a cross section of 1 mm square has a resistance of about 100 ohms per cm. With a 1 cm gap 5 between electrodes 9 and 10 and a 10 kV applied voltage, the 1 mm square carbon would conduct 100 amperes and dissipate a megawatt of power. This cannot be tolerated.

One approach to mitigating the above problem is that portions of the electrodes 9, 10 can be terminated and replaced with regions of non-conductive material, which can be swept clean by the belt. This approach will increase the path length over which a conductive path must form, and reduce the likelihood of conductive path formation. However, in the regions where the electrode is replaced with a dielectric, there is no electric field for separation, and so the efficiency of the separator is reduced. Further, a problem with such an approach is that along the edges of the separator, there is an absence of the separation electric field which leads to the belt moving material that is not separated. This unseparated material will contaminate the two separated products and reduce the efficiency of the separator. Also, even though the path length over which a conductive path must form is longer, contamination with conductive particles will still lead to the buildup of conductive layers, and eventually to break down of the gap, which will over time lead to tracking and erosion of the dielectric surfaces.

Referring to FIG. 2, according to an embodiment of the separator 100, when the separator 100 is operated the moving belt segments 8A, 8B convey the particulate material in a fluidized state. Like any fluid, the particulate material moves and fills in any voids that are available. Along the edges of the separator (for example the longitudinal sides of the electrodes 9 and 10, the feedpoint 3 and the exit points 4, 7) there are motionless surfaces. Depending on the fluid mechanical regime being operated in, there is a stagnant boundary layer of some thickness. When conductive particles collect in this boundary layer, surface conduction and tracking are the inevitable consequence of operating with conductive particles.

Some of the effects can be partially mitigated by operating at reduced throughput. This amounts to recognizing that the material is actually a three phase system with two solid phases, one of which is conductive, and air which is an excellent insulator. Accordingly, increasing the concentration of air, that is reducing the volume fraction of solid material that is in the separator will reduce the volume of conductor. Unfortunately this does not eliminate the conductive particle problem, and it does reduce the capacity of the separator. Further particles can still build up on any non-moving surface until a conductive layer is formed. This behavior is most evident when one of the species being concentrated is itself conductive, as is the case with carbon in fly ash.

U.S. Pat. Nos. 4,839,032 and 4,874,507 disclose the use of a dielectric barrier 6 between the moving belt segments 8A and 8B. This barrier can be imposed along the edges of the separator, so as to increase the path length over which a conductive path must form, in order to short out the electrodes 9, 10. However, this barrier, by blocking the field and the motion of particles from one stream to the opposite stream, also, to some effect, prevents separation. Further, the long term stability of such a barrier sheet is difficult to ensure.

In addition, a practical material to be used as barrier 6 should be flexible, in order to resist the buffeting and movement of the belt segments 8A and 8B without breaking. This requirement of flexibility precludes the use of rigid ceramic materials and requires lower modulus dielectric materials, such as polymeric materials. However, a problem with polymeric materials is that they are substantially soft, and as such, can become embedded with conductive particles, and thus can become conductive. Further, when sparking does occur, polymeric materials withstand only relatively low temperature, and as such do not resist erosion from sparking as well as ceramic materials do. As disclosed in U.S. Pat. Nos. 4,839,032 and 4,874,507, when a barrier is imposed across the separator 100, between the opposite electrodes 9, 10, charges move until a field builds up across the dielectric. Thus, when the dielectric does spark over, there is a substantial charge and energy stored in the charges on opposite sides of the dielectric barrier is dissipated in the spark, leading to erosion and tracking of the polymeric material.

Still another problem with the separator 100 of FIG. 2 is that an increased path does not preclude spark breakdown due to a direct current electric field, even though the average electric field may be far below breakdown. When an electric spark occurs, the spark channel is highly ionized and is very conductive. As a very conductive material, the spark becomes an equipotential surface. If the spark starts at one electrode, and propagates outward, then during the sparking period, the spark channel is at the same potential as the electrode. The electric field at the tip of the spark is then the gradient in potential between the electrode and the local region immediately beyond the leading tip of the spark. The strong electric field and field gradient at the tip of the spark can align particles and lead to further sparking and tracking. When a spark occurs, it generates a local region of high energy plasma, which can erode and decompose polymeric materials, resulting in carbon formation, and tracking. This carbon is quite conductive and can lead to further breakdown.

Thus, the operation of a belt-type separator on conductive particles is problematic, and the methods used to allow separation of conductive materials are limited and are not completely satisfactory for long term operation of an industrial process.

It is thus an object of this invention to provide a countercurrent belt-type separator for operating on conductive particles with a high efficiency.

It is also an object of this invention to provide a passive system that will be long-lived and require little maintenance.

It is further an object of this invention to provide a method and apparatus which allows separation of high concentrations of conductive materials.

It is still further an object of this invention to provide a method and apparatus which allows separation of conductive materials above the percolation threshold.

Further, it is an object of this invention to provide a method and apparatus which allows separation of conductive materials at a high capacity without derating due to conductivity of the particles.

According to the present invention, a method for electrostatically separating different components of a mixture of particles, including conductive particles, in a separation chamber, includes providing the separation chamber with confronting surfaces consisting of electrodes bounded by a voltage gradient assembly including alternating conductive elements and dielectric elements, whereby the conductive elements are connected to respective nodes of a voltage dropping circuit so as to limit a maximum potential difference between any two adjacent conductive elements. In addition the method includes admitting the material into the separation chamber, impressing the electric field between the confronting surfaces, separating the different components in the electric field according to their sign of charge, and mechanically moving components of like net charge in two streams of unlike net charge near each other and transversally to the electric field. Further, the method includes removing the separated components of the mixture of particles from the separation chamber.

With this arrangement, the effects of surface conduction and tracking due to conductive particles collecting in stagnant regions of the separator are reduced and thus the counter-current belt-type separator can be operated at a higher throughput capacity, with a high efficiency, and can be used to separate high concentrations of conductive materials from a mixture.

According to the present invention, an apparatus for electrostatic separation of a mixture of particles, containing conductive particles, includes a separation chamber having at least a pair of electrodes, at least one transport belt disposed between a pair of supports so as to simultaneously agitate and transport the mixture of particles between the pair of electrodes, in at least two streams, and a voltage gradient assembly including alternating conductive and dielectric elements, disposed along at least longitudinal edges of the separator. The conductive elements, of the voltage gradient assembly, are coupled to respective nodes of a voltage dividing circuit which limits a maximum potential difference between any two adjacent conductive elements.

With this arrangement, the effects of surface conduction and tracking due to conductive particles collecting in stagnant regions of the separator are reduced and thus the counter-current belt-type separator can be operated at a higher throughput capacity, with a high efficiency, and can be used to separate high concentrations of conductive materials from a mixture.

In an embodiment of the present invention, the voltage gradient assembly is formed from an extruded plastic composite containing both conductive and non-conductive regions of plastic and also containing non-conductive dielectric elements. This extruded plastic composite is coupled to at least one printed circuit board housing the voltage dividing circuit.

With this arrangement, the counter-current belt-type separator requires little maintenance and is resistant to abrasion from the constant interaction with the moving belts.

BRIEF DESCRIPTION OF THE DRAWINGS

The foregoing and other objects and advantages of the invention will become apparent with reference to the following detailed description when taken in connection with the drawings, in which.

DETAILED DESCRIPTION

In the operation of high voltage, direct current (DC) equipment in an atmosphere, there are two criteria for formulation of a spark. A spark in this sense is defined as an avalanche of electrons where the electric field provides sufficient energy to electrons to promote further impact ionization of molecules and this leads to an exponential increase in current, thermal heating and eventually thermal ionization, and typically, a visible and audible spark channel.

A first criteria is the electric field or the voltage gradient must be sufficient to provide energy to free electrons at a rate higher than electrons lose energy to the gas, such that the electrons can increase in energy to a level where they can cause further ionization. A second criteria is that the potential difference between the high potential and the low potential must exceed a certain critical value. This critical value is a function of the gas composition, and to some extent, of the electrode; specifically the secondary electron emission properties, the work function, and field emission properties of the electrode. The breakdown properties of liquids and solids are typically much higher than breakdown fields for gases, primarily because the mean free path of electrons in liquids or solids is much shorter, and so an electric field must supply energy at a higher rate to an electron in a solid or liquid to achieve energies necessary for further ionization.

Figure 2:
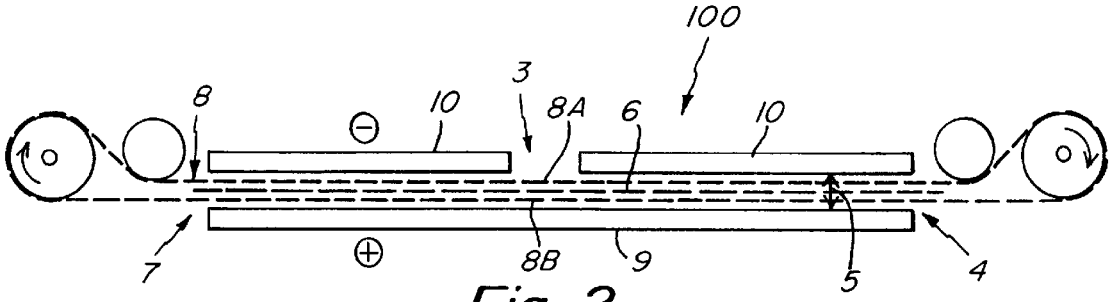
Fig. 2 (RELATED ART)
FIG. 2 is a schematic illustration of a particle separating apparatus according to the related art.

Referring to the separator 100 of FIG. 2, when the gap 5 between conductors 9, 10 is large, the limiting criteria for break down is that the electric field must be above a certain limit. This results in the value of 30 kV/cm for the break down strength of air. When the gap 5 is very small, then the limiting criteria becomes that the potential difference must exceed the sparking potential of the gas. This minimum sparking potential behavior was found by Paschen, and is termed Paschen's law. For air, the minimum sparking potential is 327 volts and occurs at a gap of about 7.5 microns at 1 atmosphere. This represents a field of 440 kV/cm.

Figure 1:
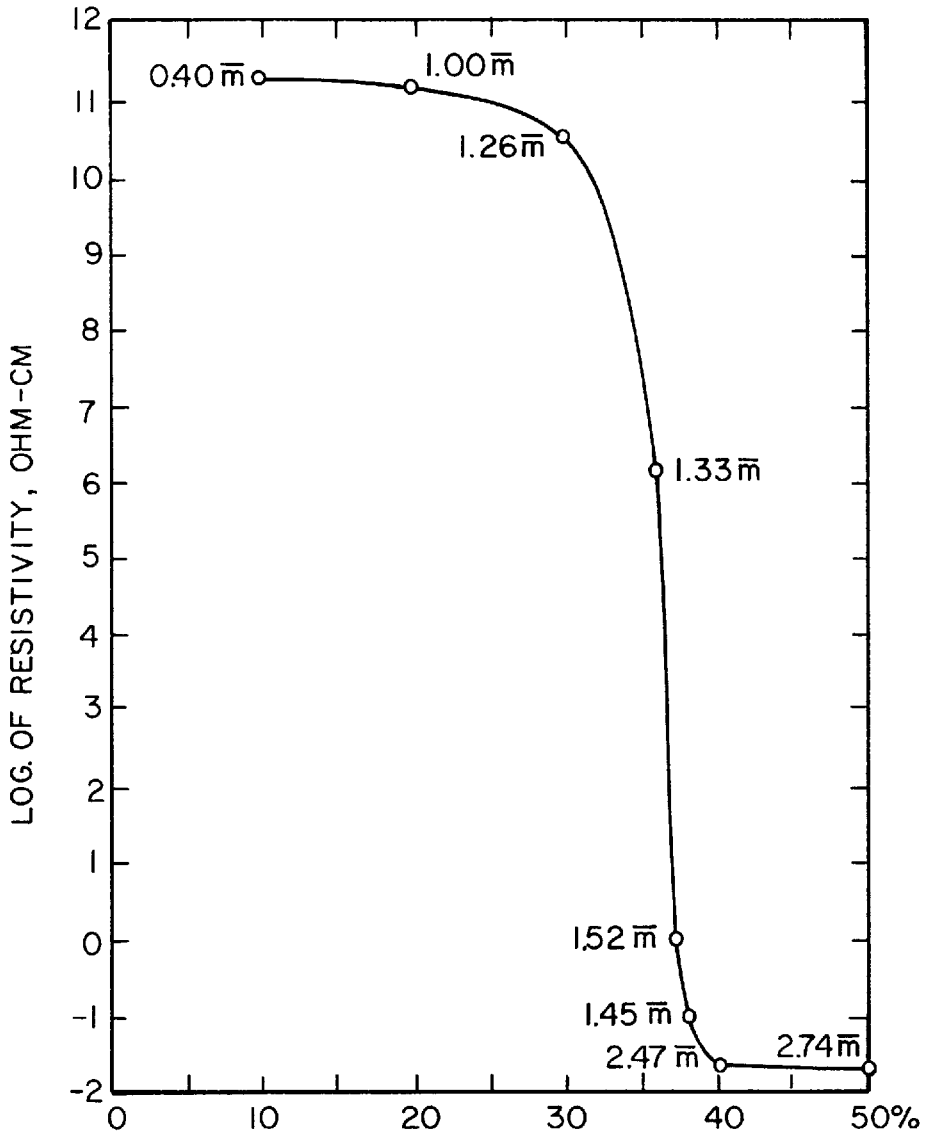
Fig. 1 (RELATED ART)
FIG. 1 is a graph of resistivity versus volume percent of a composite of particular material as is known in the related art.

The tendency of the electrodes in a belt-type separator, for example electrodes 9, 10 of FIG. 1, to spark over and short out can be reduced by controlling the maximum potential difference and the maximum electric field that is present along solid surfaces inside the separator, especially where conductive particles may build up and cause conductive paths. According to the present invention, the potential difference, and hence the maximum electric field between different regions is controlled by providing conductive elements, alternately disposed between non-conductive elements, between electrodes 9, 10 and a reference potential and electrically connecting the conductive elements to a voltage dividing assembly so as to control the maximum potential difference between the adjacent conductive elements.

Figure 3:
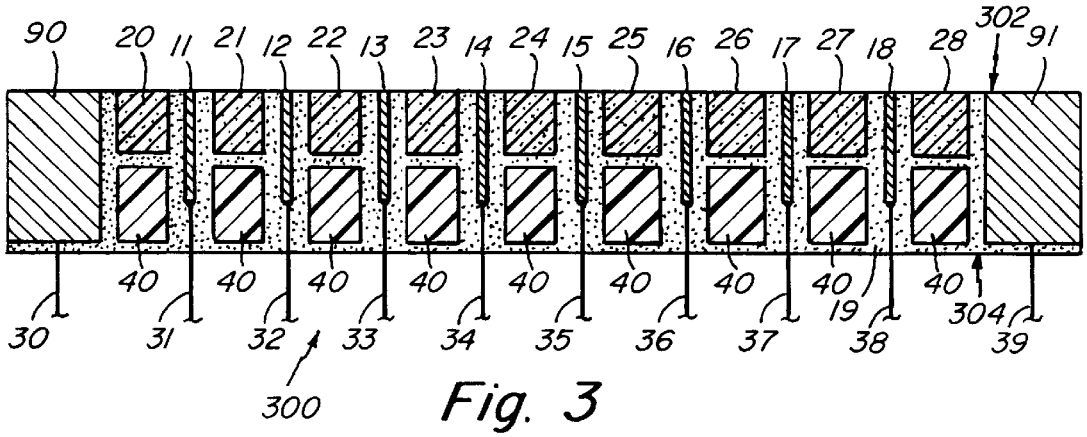
FIG. 3 is a cross sectional view illustration of a voltage gradient assembly according to the present invention.

Referring to FIG. 3, there is illustrated a diagram of a voltage gradient assembly, according to an embodiment of the present invention, for providing a controlled maximum potential difference between electrodes 9, 10 of separator 100. It is to be appreciated that the illustrative implementation shown is merely examplary with respect to the number of conductors and dielectric elements, the manner in which they are arranged, the manner in which they are supported, their shape and size, and the like and that numerous modifications can be employed and are intended to be covered by the present invention.

The voltage gradient assembly 300 has a confronting face 302 formed by dielectric elements 20–28 and conductor elements 11–18. The confronting face 302 is situated such that it faces the moving belts 8A, 8B and is disposed between a surface 91 at a high potential and a low potential surface 90, which in one embodiment is coupled to ground.

The conductive elements 90, 11–18, and 91 are connected through connections 30–39 respectively to a voltage dividing circuit. The dielectric elements 20–28 are supported by insulating mechanical supports 40 and a polymeric potting adhesive 19 which mechanically adheres the assembly together and electrically seals a rear face 304 of the voltage gradient assembly 300 from contact with other mechanical supports (not shown). The conductor elements 11–18 are connected through connections 30–39 to a voltage dropping circuit such as, for example, shown in FIGS. 4 and 5. In particular, connection 30 is coupled to node 130, connection 31 is coupled to node 131, connection 32 is coupled to node 132, connection 33 is connected to node 133, and the like of FIGS. 4 and 5.

Figure 4:
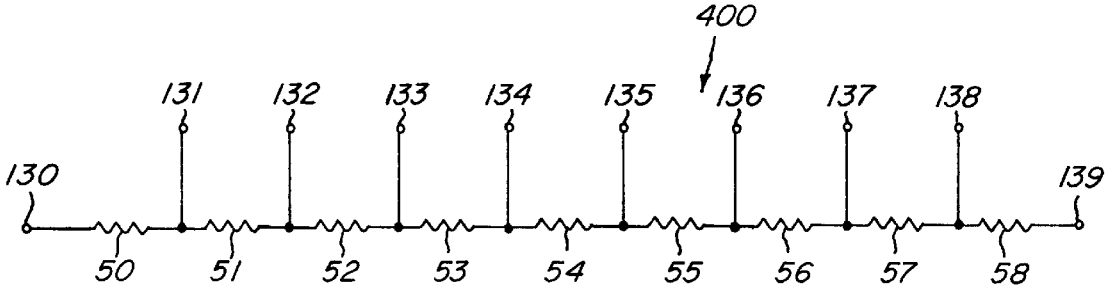
FIG. 4 is a schematic diagram of an embodiment of a voltage dropping circuit according to the present invention.

Referring now to FIG. 4, FIG. 4 is a schematic diagram of an embodiment of a voltage dropping circuit 400 including a plurality of resistors 50–58. The resistors 50–58 are connected in series as shown between the surface 91 at the high potential, which is coupled to the circuit at node 139, and the surface 90 at the reference potential, which is coupled to the circuit at node 130. The resistor elements 50–58 produce a sequential voltage drop from surface 91 to surface 90. In a preferred embodiment of the voltage dividing circuit 400, resistors 50–58 are of equal value so that the high voltage potential at surface 91 is equally divided across each of the resistors 50–58. The sequential voltage drop at nodes 131–138, respectively coupled to conductive elements 31–38 of the voltage gradient assembly 300, provides a gradual change in the voltage from the surface 91 to the surface 90 so as to reduce the tendency for sparking between any conductive elements.

This type of controlled voltage drop has been used in other high voltage applications, such as in Van de Graaf generators to limit the maximum electric field and to reduce spark over between different high voltage components. Such voltage gradient devices typically use resistors to produce a controlled voltage drop and to divide the high voltage into a number of smaller voltage steps. Further, in the high voltage transmission systems of alternating current, ceramic insulators are frequently used. These insulators typically have a corrugated surface, and typically divide the voltage from a high voltage to ground through a capacitive voltage dropping mechanism. However, a capacitive voltage dropping mechanism is ineffective with DC voltages. A preferred device for dividing the DC voltages is thus a high impedance, under normal operating conditions, and a low impedance to voltages above normal operating conditions. This non-linear voltage current characteristic can be achieved, for example, using non-linear components such as varistors or zener diodes.

Figure 5:
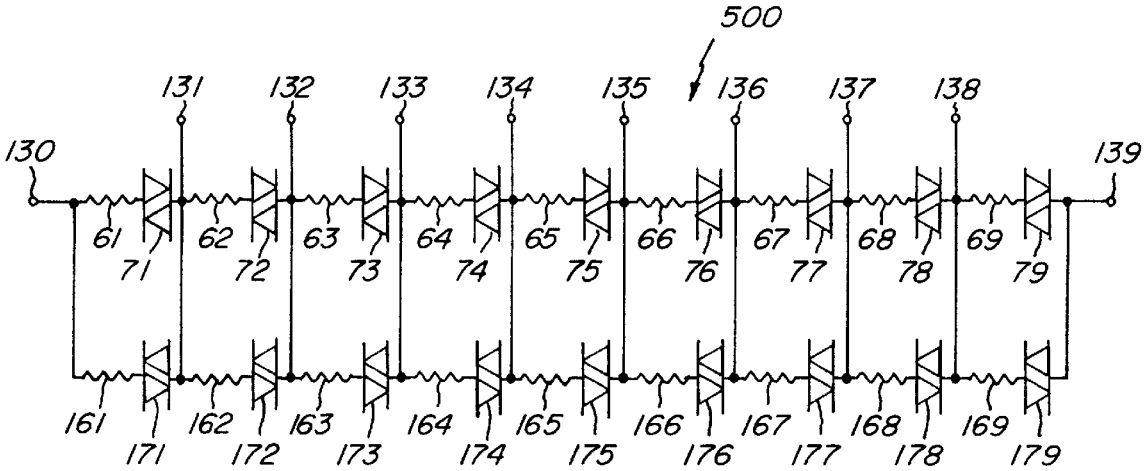
FIG. 5 is a schematic diagram of another embodiment of a voltage dropping circuit according to the present invention.

FIG. 5 is a schematic diagram of voltage dropping circuit 500, according to another embodiment of the present invention, which uses a plurality of varistors. Varistors 71–79 and 171–179 have a non-linear current-voltage curve where the current increases exponentially above a characteristic "turn-on" voltage. In FIG. 5, a first chain of varistor elements 71–79 are inter-disposed respectively in series with resistor elements 61–69. In addition, a second chain of varistor elements 171–179 are inter-disposed respectively in series with resistor elements 161–169. In addition, the second chain is disposed in parallel with the first chain. The resistors 61–69 and 161–169 ensure that the varistors are dividing any current flowing in the circuit between nodes 130 and 139.

Since varistor elements have an exponential voltage current relationship, the current flow in a varistor is sensitive to the voltage across the varistor element. In addition, in reality each varistor element is slightly different. Further, as a temperature of a varistor increases, the current at a given voltage also increases. Thus, a possible mode of failure of this embodiment of the voltage-dividing circuit 500 is that one varistor will carry more current than the other varistors, resulting in the varistor's temperature rising such that it carries more current, until there is a thermal runaway of the varistor device and eventual device failure. Thus, in order to prevent this thermal runaway of any particular varistor 71–79 and 171–179, the resistors 61–69 and 161–169 are used to bring the operating point of the varistor-resistor combination into similar operating regions.

In one embodiment of the voltage-dividing circuit according to the present invention, varistors SK20680, made by Siemens Co. are used for elements 71–79 and 171–179. These varistors are rated to dissipate one watt, which corresponds to a voltage of approximately 1,000 volts at a current of 1 milliamp. Thus, if resistors 61–69 are chosen to have a resistance of 100,000 ohms, at one milliamp of current, there will be a voltage drop of one hundred volts across each resistor. The additional resistance of each resistor stabilizes the operating point of the circuit 500 so that a plurality of chains of varistors elements can be connected in parallel to increase the overall current carrying capacity of the circuit 500 while maintaining stable operation.

With the voltage dropping circuit of FIG. 5, the voltage is clamped by the varistors 71–79 and 171–179 at the operating point of the varistor. The varistor type of voltage clamping circuit is preferred over the zener diode system because the varistors are bi-directional components, as opposed to zener diodes, which are unidirectional. Thus, the varistors 71–79 and 171–179 will limit the potential difference between any two conductors 11–18 (FIG. 3) at either polarity. Also varistors are typically cheaper and more rugged devices in high power operations, and have voltage ratings that are convenient for use in voltage divider circuits.

Figure 6:
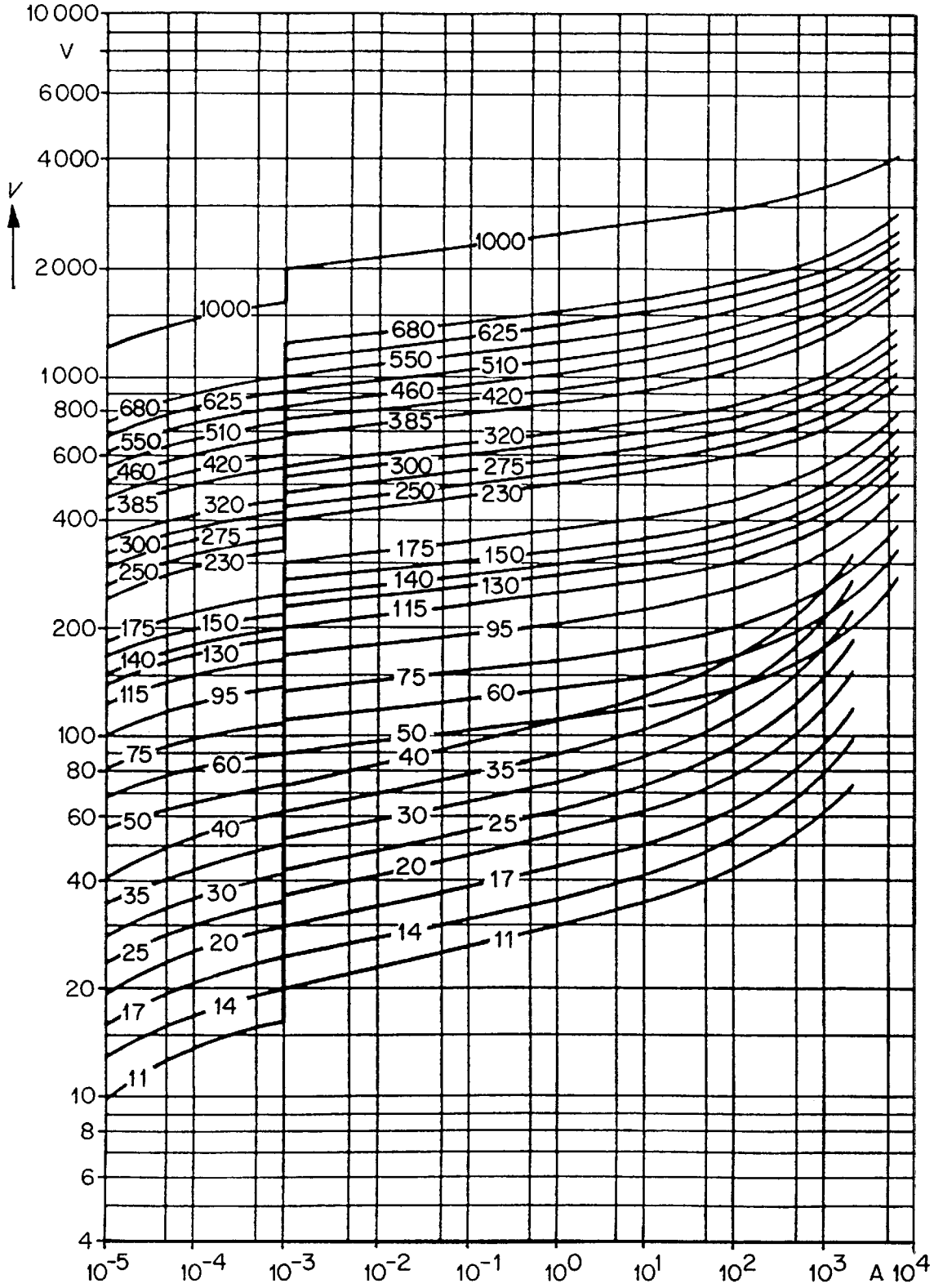
FIG. 6 is a graph of the current-voltage curve of non-linear varistors as used in the voltage dividing embodiment shown in FIG. 5.

The use of non-linear passive elements, such as varistors provide several additional benefits. For example, when the voltage drop across the varistor is less than the clamping voltage, the current flow is very small. FIG. 6 shows a typical V-I characteristics for the S20K680 metal oxide varistor with a nominal ac operating voltage of 680 V rms. One advantage of the voltage dividing circuit of FIG. 5 is that the number of voltage dropping elements can be large, with no risk that a high potential could buildup in the interior of the voltage dropping chain. Thus, the voltage across the entire chain is limited to the supply voltage and the maximum voltage across any pair of adjacent conductive elements 11–18 (FIG. 3) is limited to the varistor clamping voltage. The actual voltage across any pair of adjacent conductors 11–18 is a dynamic value which depends on the conductivity of any other elements in the series path. Thus if across one pair of adjacent conductors a partially conductive layer allows the conduction of a few microamps of current, the voltage across that pair of conductors will drop, until the current through the conductive layer equals the current as limited by the other varistors in series.

According to the present invention, limiting the maximum potential difference between adjacent conductive elements with the voltage gradient assembly, provides several benefits. For example, limiting the field gradient at the end of a conductive path of the separator (e.g. longitudinal ends of the separator) reduces the dielectrophoretic force on the particles that the electric field gradient imposes on the particles. These forces tend to cause particles to aggregate and form pearl chains. Pearl chains result when the particles are conductive and the attractive forces bring the particles together and form a conductive chain. To become conductive, every gap in a chain must have a potential drop of at least the sparking potential for air, or 327 volts for a gap of 7.5 microns. Thus, a strong field can move particles and cause this gap to be bridged. Similarly a strong field can increase the contact area and reduce the contact resistance between adjacent particles.

For example, in one embodiment of the present invention, it has been found that for the separation of carbon from fly ash, limiting the maximum voltage between conductive elements, of the voltage gradient assembly, to about 700 volts is sufficient to suppress the effects of shorting of the electric field between electrodes. The minimum voltage required to initiate a spark is 327 volts when the gap is 7.5 microns. Thus with the maximum voltage limited to 700 volts, two such gaps will eliminate the possibility of conduction between the two conductors.

Thus, the voltage reduction circuits as shown in FIG. 4–5, in combination with the voltage gradient assembly 300, is used to limit the potential difference and hence the electric field and electric field gradient in the air gap between the confronting surfaces 9, 10 of the electrostatic separator 100 (FIG. 2). At the longitudinal edge regions of the separator 100, the electric field is tangential to the edge surface. In order to further limit the electric field in the air gap and reduce the pearl chaining effect, it is desirable to use a material with a high dielectric constant, so that the electric field within the air gap is reduced still further. Thus, it is to be appreciated that an arrangement of conductors at certain potentials, surrounded by dielectrics of certain dielectric constants, results in a distribution of conductors and dielectrics which can have substantial effects on the ambient electric field.

Figure 9:
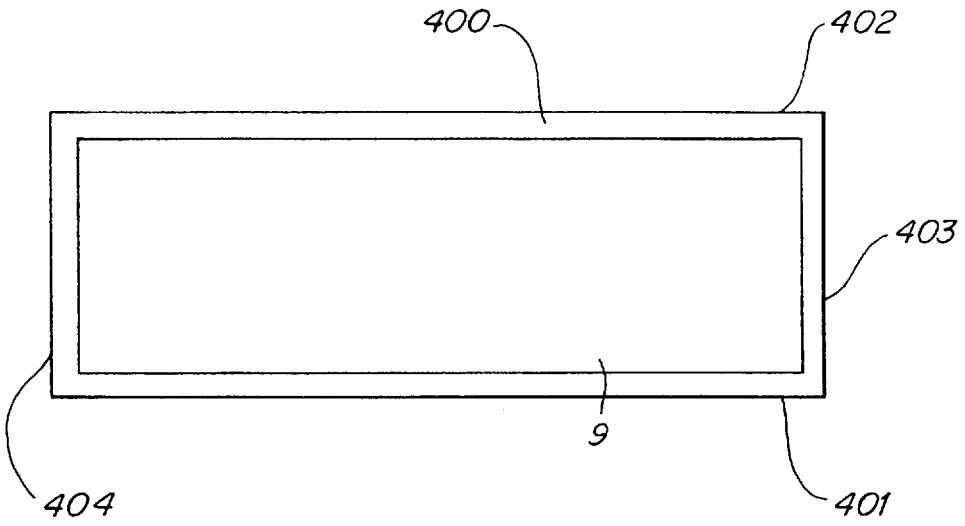
FIG. 9 illustrates a top view of one embodiment of one electrode of the particle separating apparatus of FIG. 2 including a voltage gradient assembly in accordance with the present invention.
Figure 10:
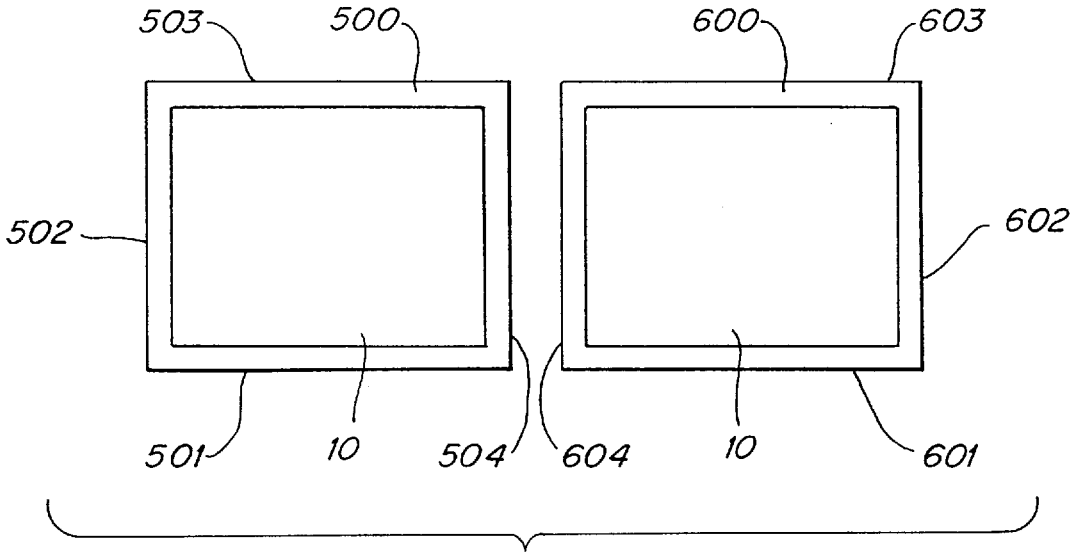
FIG. 10 illustrates a bottom view of one embodiment of the other electrode of the particle separating apparatus of FIG. 2 including a voltage gradient assembly in accordance with the present invention.

It is also to be appreciated, that the configuration of the conductors and insulators is important. The parallel plane geometry of the separator requires that all interfaces between the high voltage electrodes and the stationary mechanical support structure be protected from spark over and break down. Thus, referring to FIG. 2, this requirement is necessary for example at the longitudinal edges of the electrodes 9, 10, at the ends of the electrodes 9, 10 adjacent exit points 4, 7 at feed point 3 where feed is introduced through a slot in the electrode, and at any spaced charge, discharge ports in the electrodes 9, 12. FIG. 9 is a bottom view of electrode 9 of particle separating apparatus 100 including a voltage gradient assembly 400 of the present invention disposed along longitudinal edges 401, 402 and ends 403 and 404 of electrode 9. FIG. 10 is a top view of electrode 10 of particle separating apparatus including a voltage gradient assemblies 500 and 600 disposed along longitudinal edges 501, 503, 601, and 603 and ends 502, 504, 602 and 604 of electrode 10.

It is also to be appreciated that the tendency for breakdown is different at the different edges of the electrode surfaces, and also depends on the material being separated and the concentration developed in the separator. In the case of fly ash, the low carbon end is typically less than 3% carbon, and so there is less tendency for sparking and shorting. At the high carbon end the carbon content can exceed 50% carbon, so the tendency to short is very high. Along the edges of the separator 100 there is a continuous variation from the low value to the high value. Thus depending upon the service that is expected for a given application, it is to be appreciated that the different edges in the separator can have different configurations in order to simplify separator construction in areas where very high levels of protection are not required.

The present invention is useful in the separation of many mixtures which contain conductive particles. Examples of such materials include fly ash with conductive particles of carbon, grinding swarf from metal finishing operations containing metallic particles, metal containing slags and dross from pyrometalurgical operations, graphite ores, metallic sulfide ores, silicon containing slags, coal which can contain particles of charcoal and metal sulfides, anthracite which can itself be conductive, carbon containing waste products, mineral sands, and silicon carbide.

It is also to be appreciated that the choice of materials of construction is important. The insulating material should have a high dielectric constant, good electrical tracking resistance, abrasion resistance, and should be dimensionally stable in the separator. One example of a material that works well is high purity high density sintered polycrystalline alumina. This material is very hard, very abrasion resistant, is a very good insulator up to high temperatures and is readily available. However, other ceramic materials can also be used such as mullite, spinel, quartz, sapphire, porcelain, glass, or other high dielectric constant materials such as barium titanate. In some applications polymeric materials may be used, where the sparking has been suppressed and there is no spark erosion. Further, wear resistant polymeric materials such as ultra high molecular weight polyethylene, urethanes, or PTFE can also be used when the abrasion is not so severe.

It is further to be appreciated that the choice of conductor materials is much broader. The current carrying capacity requirements are very low, so that the material need not be a good conductor. Further, erosion of the conductive material is less of a problem when it is surrounded by a an insulating material such as, for example, hard alumina. Conductors can be chosen of metal, or of conductive plastic. Both types of systems have been used, and both work well.

Figure 7A:
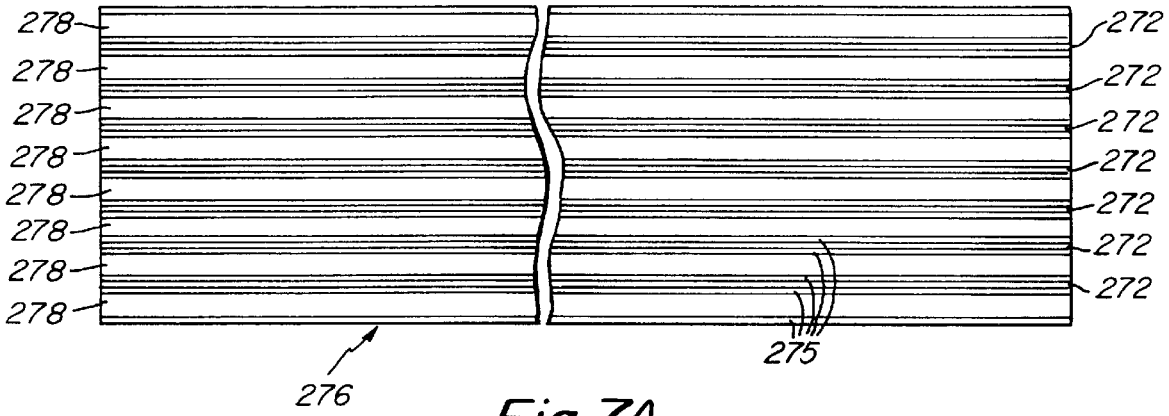
FIGS. 7A and 7B illustrate a co-extruded voltage gradient assembly according to one embodiment of the present invention FIG. 7A being a top plan view and FIG. 7B and end view.
Figure 7B:
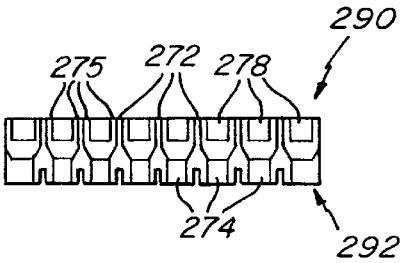

Referring to FIGS. 7A and 7B, one embodiment of the voltage gradient assembly 276 according to the present invention includes a conductive plastic material 272 is co-extruded with insulating plastic material 274 resulting in a composite piece 276. The composite piece 276 can be extruded at low cost and, for example, insulating alumina pieces 278 can be cemented 275 in place between adjacent conductive plastic pieces 272, thereby providing a durable front surface 290 to prevent electrical tracking.

Figure 8:
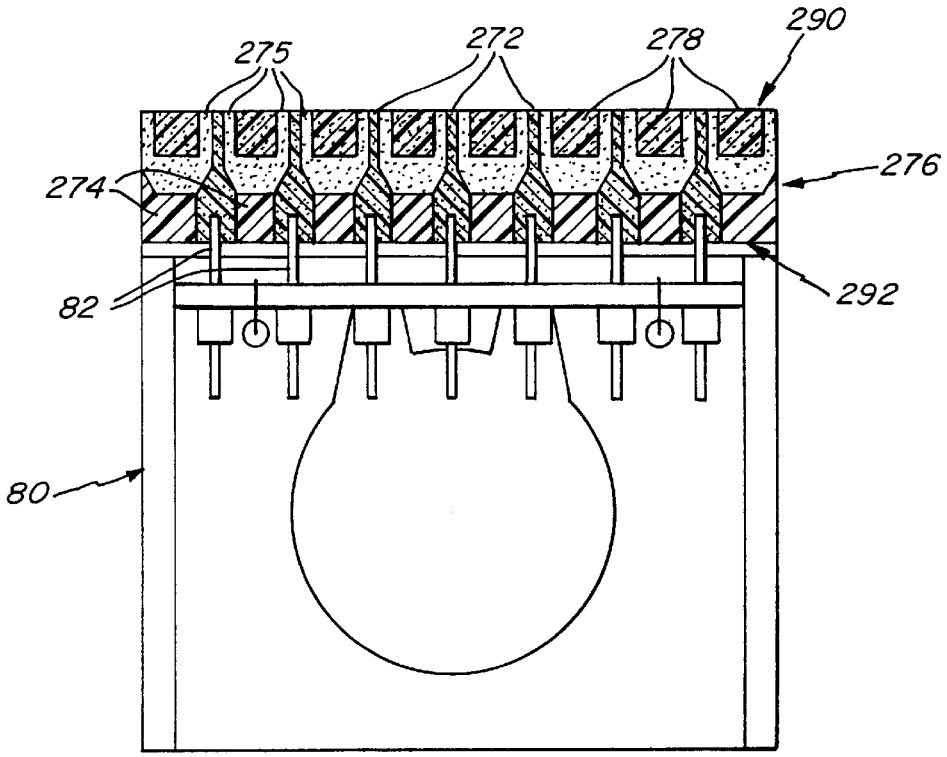
FIG. 8 is a cross-sectional view of a printed circuit board housing the voltage dropping circuit of one of FIGS. 4 and 5 and having connectors for coupling to a back side of the co-extruded voltage gradient assembly of FIGS. 7A and 7B.

Referring now to FIG. 8, there is illustrated a printed circuit board 80 housing a voltage dividing circuit having plural connectors 82. The voltage dividing circuit board 80 can be attached, with connectors 82, to the back side 292 of extruded piece 276, and the entire assembly potted with a suitable dielectric encapsulate not shown to protect the components from the dusty environment inside the separator.

The voltage gradient assembly has been experimentally proven to be quite effective in preventing sparking and tracking voltage breakdown in operation of a full-size belt-type separator in the separation of carbon from fly ash. A separator incorporating these components has demonstrated long term operation while producing a high carbon stream in excess of 50% carbon by weight. This represents a very high volume fraction conductive material, and a separator at this concentration, in the absence of these voltage gradient assembly pieces 76 would short out very rapidly.

Having thus described several particular embodiments of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is limited only as defined in the following claims and the equivalents thereto.

What is claimed is:

1. A method of electrostatically separating different components of a mixture of particles in a separation chamber, the mixture of particles including first and second components, the method comprising the steps of:

admitting the mixture into the separation chamber, the separation chamber having electrodes with confronting surfaces;

controlling a voltage difference between the electrodes with at least one voltage gradient assembly by bounding said electrodes with said voltage gradient assembly, said at least one voltage gradient assembly including alternating conductive elements and dielectric elements, wherein respective conductive elements are connected to respective nodes of a voltage dropping circuit so as to limit a maximum potential difference between any two conductive elements;

impressing an electric field between the confronting surfaces of the electrodes;

separating the first and second components of the mixture according to a sign of charge of each of the first and second components, respectively; and mechanically moving components of like net charge in at least two streams, each of unlike net charge, near each other transversely to said electric field, the at least two streams being in communication parallel to the electric field, so as to transfer a portion of at least one of said components from one stream to another of said respective streams by virtue of the continued action of said electric field as said streams progress transversely to said electric field.

2. A method of electrostatically separating different components of a mixture of particles, which includes conductive particles, in a separation chamber, comprising the steps of:

admitting the mixture into the separation chamber, the separation chamber having confronting surfaces consisting of electrodes, wherein at least one electrode is bounded by a voltage gradient assembly including alternating conductive elements and dielectric elements, wherein respective conductive elements are connected to respective nodes of a voltage dropping circuit so as to limit a maximum potential difference between any two conductive elements;

impressing an electric field between the confronting surfaces of said separation chamber;

separating said different components in a direction of said electric field according to their sign of charge;

mechanically moving components of like net charge in at least two streams, each of unlike net charge, near each other transversely to said electric field, the at least two streams being in communication parallel to electric field, so as to transfer a portion of at least one of said components to another of said respective streams by virtue of the continued action of said electric field as said streams progress transversely to said electric field; and removing separated components from said separation chamber, wherein the separation chamber further includes a mesh belt supported by rollers at ends of the separation chamber and wherein longitudinal sides of the separation chamber and the mesh belt are bounded by a plurality of voltage gradient assemblies.

3. The method of claim 2, wherein the ends of the separation chamber are also bounded by the plurality of voltage gradient assemblies.

4. An apparatus for triboelectric electrostatic separation of a mixture of particles, the apparatus comprising:

first and second electrodes;

at least one transport belt supported between at least two supports so as to simultaneously agitate and transport the mixture of particles between the first and second electrodes, in at least two streams of unlike net charge; and a voltage gradient assembly including alternating conductive and dielectric elements, the voltage gradient assembly bounding at least one of the first and second electrodes, whereby respective conductive elements are electrically coupled to nodes of a voltage dividing circuit which limits a maximum potential difference between any two conductive elements.

5. The apparatus of claim 4, wherein the ends of the separation chamber are also bounded by the voltage gradient assembly.

6. An apparatus for triboelectric electrostatic separation of a mixture of particles containing conductive particles, the apparatus comprising:

a plurality of electrodes;

at least one transport belt supported between at least two supports so as to simultaneously agitate and transport the mixture of particles between the plurality of electrodes, in at least two streams of unlike net charge; and a voltage gradient assembly including alternating conductive and dielectric elements, whereby respective conductive elements are electrically coupled to nodes of a voltage dividing circuit which limits a maximum potential different between any two conductive elements, wherein the at least one transport belt is a mesh belt supported by rollers at ends of the separation chamber and wherein longitudinal sides of the separation chamber and the mesh belt are bounded by the voltage gradient assembly.

7. A method of electrostatically separating different components of a mixture of particles in a separation chamber, the mixture of particles including first and second components, the method comprising the steps of:

admitting the mixture into the separation chamber, the separation chamber having electrodes with confronting surfaces;

controlling a voltage difference between the electrodes with at least one voltage gradient assembly by bounding said electrodes with said voltage gradient assembly, said at least one voltage gradient assembly including alternating conductive elements and dielectric elements, wherein respective conductive elements are connected to respective nodes of a voltage dropping circuit so as to limit a maximum potential difference between any two conductive elements;

impressing an electric field between the confronting surfaces of the electrodes;

separating the first and second components of the mixture according to a sign of charge of each of the first and second components, respectively;

mechanically moving components of like net charge in at least two streams, each of unlike net charge, near each other transversely to said electric field, the at least two streams being in communication parallel to the electric field, so as to transfer a portion of at least one of said components from one stream to another of said respective streams by virtue of the continued action of said electric field as said streams progress transversely to said electric field; and wherein the separation chamber further Includes a mesh belt supported by rollers at ends of the separation chamber and wherein longitudinal sides of the separation chamber and the mesh belt are bounded by at least one voltage gradient assembly.

8. The method of claim 7, wherein the voltage dropping circuit includes a plurality of varistors.

9. The method of claim 7, wherein the voltage dropping circuit includes a plurality of resistors.

10. The method of claim 7, wherein the voltage dropping circuit includes a plurality of non-linear voltage-current elements.

11. The method of claim 7, wherein the mixture of components to be separated is chosen from the list of carbon containing fly ash and pulverized coal.

12. The method of claim 7, wherein the dielectric elements include alumina.

13. The method of claim 7, wherein each voltage gradient assembly includes an extruded plastic composite piece containing conductive and non-conductive regions of plastic.

14. The method of claim 13, wherein each voltage gradient assembly further includes a plurality of dielectric pieces, including alumina, disposed between the conductive regions.

15. The method of claim 13, wherein the voltage gradient assembly further includes at least one circuit board housing the voltage dropping circuit.

16. The method of claim 7, wherein the maximum voltage potential difference, between any two conductive elements is limited to less than about one thousand volts.

17. The method according to claim 7, wherein the at least one voltage gradient assembly includes a plurality of voltage gradient assemblies, each of the plurality of voltage gradient assemblies bounding longitudinal sides of the separation chamber and the mesh belt.

18. An apparatus for triboelectric electrostatic separation of a mixture of particles, the apparatus comprising:

first and second electrodes;

at least one transport belt supported between at least two supports so as to simultaneously agitate and transport the mixture of particles between the first and second electrodes, in at least two streams of unlike net charge;

a voltage gradient assembly including alternating conductive and dielectric elements, the voltage gradient assembly bounding at least one of the first and second electrodes, whereby respective conductive elements are electrically coupled to nodes of a voltage dividing circuit which limits a maximum potential difference between any two conductive elements; and wherein the transport belt is a mesh belt and longitudinal sides of the separation chamber and the mesh belt are bounded by the voltage gradient assembly.

19. The apparatus of claim 18, wherein the voltage dividing assembly includes an extruded plastic composite consisting of conductive and non-conductive regions of plastic and non-conductive dielectric elements.

20. The apparatus of claim 19, wherein the voltage dividing assembly further includes at least one circuit board housing the voltage dividing circuit.

21. The apparatus of claim 19, whereby the non-conductive dielectric elements are chosen from the list of alumina, sapphire, cordeurite, mullite, porcelain, glass, ultra-high molecular weight polyethylene, PTFE, polyester.

22. The apparatus of claim 18, wherein the voltage dropping circuit includes a plurality of varistors.

23. The apparatus of claim 18, wherein the voltage dropping circuit includes a plurality of resistors.

24. The apparatus of claim 18, wherein the voltage dropping circuit includes a plurality of non-linear voltage-current elements.

25. The apparatus of claim 18, wherein the mixture of components to be separated is chosen from the list of carbon containing fly ash and pulverized coal.

26. The apparatus of claim 18, wherein the maximum voltage potential difference, between any two conductive elements, is limited to less than about one thousand volts.

27. An apparatus for separating particles, comprising:

a first electrode having a longitudinal edge and an end;

a second electrode having a longitudinal edge and an end;

a first roller disposed at a first end of the apparatus;

a second roller disposed at a second end of the apparatus;

a mesh transport belt disposed between the first and second electrodes, the mesh transport belt being supported by the first and second rollers; and a voltage gradient assembly formed of alternating conductive elements and dielectric elements, the voltage gradient assembly being at least partially disposed along a longitudinal edge of the first or second electrode.

28. The apparatus according to claim 27, wherein the conductive elements are connected to respective nodes of a voltage dropping circuit.

29. The apparatus according to claim 28, wherein the voltage gradient assembly is disposed along the longitudinal edge and end of the first electrode.

30. The apparatus according to claim 29, wherein the voltage gradient assembly is disposed along the longitudinal edge and end of the second electrode.

31. The apparatus according to claim 27, wherein the voltage gradient assembly is disposed along the longitudinal edge and end of the first electrode.

32. The apparatus according to claim 31, wherein the voltage gradient assembly is disposed along the longitudinal edge and end of the second electrode.

* * * * *